US009039127B2

(12) United States Patent
Yokozawa

(10) Patent No.: US 9,039,127 B2
(45) Date of Patent: May 26, 2015

(54) DRIVER APPARATUS, IMAGE FORMING APPARATUS, AND METHOD OF CONTROLLING DRIVER APPARATUS

(71) Applicant: Suguru Yokozawa, Kanagawa (JP)

(72) Inventor: Suguru Yokozawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/092,604

(22) Filed: Nov. 27, 2013

(65) Prior Publication Data

US 2014/0152736 A1 Jun. 5, 2014

(30) Foreign Application Priority Data

Dec. 5, 2012 (JP) ..... 2012-266703

(51) Int. Cl.

| | |
|---|---|
| ***B41J 29/393*** | (2006.01) |
| ***B41J 19/20*** | (2006.01) |
| ***B41J 2/12*** | (2006.01) |
| ***B41J 29/38*** | (2006.01) |
| *B41J 23/00* | (2006.01) |

(52) U.S. Cl.

CPC *B41J 19/205* (2013.01); *B41J 2/12* (2013.01); *B41J 29/38* (2013.01); *B41J 19/207* (2013.01)

(58) Field of Classification Search

CPC ..... B41J 2/045; B41J 2/04503; B41J 2/13; B41J 2/15; B41J 29/38; B41J 29/387; B41J 29/393; B41J 19/202–19/207

USPC ..... 347/19, 37, 39

See application file for complete search history.

(56) References Cited

U.S. PATENT DOCUMENTS

| | | | | |
|---|---|---|---|---|
| 4,990,004 | A * | 2/1991 | Kawahara et al. | 400/56 |
| 5,368,402 | A * | 11/1994 | Takahashi et al. | 400/279 |
| 6,000,865 | A * | 12/1999 | Takamizawa et al. | 400/74 |
| 6,722,754 | B1 * | 4/2004 | Delaney et al. | 347/19 |
| 7,868,568 | B2 * | 1/2011 | Iesaki | 318/280 |
| 8,020,959 | B2 * | 9/2011 | Yamashiro et al. | 347/16 |
| 8,141,978 | B2 * | 3/2012 | Miyazawa | 347/19 |
| 2012/0007904 | A1 * | 1/2012 | Anzai et al. | 347/9 |

FOREIGN PATENT DOCUMENTS

| | | | | |
|---|---|---|---|---|
| JP | 57025982 | A * | 2/1982 | B41J 29/38 |
| JP | 2003-145877 | | 5/2003 | |
| JP | 2009-143196 | | 7/2009 | |

* cited by examiner

*Primary Examiner* — Jannelle M Lebron
*Assistant Examiner* — Jeremy Bishop
(74) *Attorney, Agent, or Firm* — Duft Bronsen & Fettig LLP

(57) ABSTRACT

A driver apparatus includes a drive unit to move a moveable unit along a given path using a drive force; a movement detector to detect movement of the moveable unit; a drive control unit to control the drive unit using a given output for a given time to drive the moveable unit; a determination unit to determine whether the movement detector detects a movement of the moveable unit for a given distance or more in a driving direction when the moveable unit is driven under a control of the drive control unit; and an abnormality detector to determine occurrence of abnormal when the determination unit determines that the moveable unit does not move the given distance or more.

7 Claims, 10 Drawing Sheets

DRIVER APPARATUS, IMAGE FORMING APPARATUS, AND METHOD OF CONTROLLING DRIVER APPARATUS

CROSS-REFERENCE TO RELATED APPLICATION

This application claims priority pursuant to 35 U.S.C. §119 to Japanese Patent Application No. 2012-266703, filed on Dec. 5, 2012 in the Japan Patent Office, the disclosures of which is incorporated by reference herein in their entirety.

BACKGROUND

1. Technical Field

The present invention relates to a driver apparatus that drives and moves a moveable unit in a given path, and an image forming apparatus including the driver apparatus.

2. Background Art

In image forming apparatuses using the inkjet method, a moveable unit such as a carriage includes a recording head having nozzles to dispense ink droplets. Further, a driver apparatus including a drive unit such as a main scanning motor (or scanning motor) for driving and moving the carriage along an axis is disposed in the apparatuses. The axis is set along the main scanning direction which is perpendicular to the sub-scanning direction that is a transportation direction of a recording medium.

In such image forming apparatuses using the inkjet method, while the carriage is driven and moved bi-directionally along the axis using the main scanning motor, ink droplets are dispensed from nozzles of the carriage at a given timing of forming an image on a recording medium based on image data. The control of moving the carriage bi-directionally in the main scanning direction may be referred to as carriage control in the main scanning direction. In the image forming apparatuses that conducts the carriage control in the main scanning direction, a position of the carriage in the apparatuses needs to be detected correctly to form an image on a target position on a recording medium. An encoder is attached to the carriage and a linear scale is disposed in parallel to the main scanning direction in the apparatuses to detect the carriage position.

In such image forming apparatuses, a controller conducts the following feedback control to drive the carriage. In this feedback control, the controller instructs the encoder to read the linear scale when the carriage is moved along the main scanning direction. Based on encoder signals output from the encoder such as an encoder sensor, the carriage position is detected, and position information of the carriage is obtained. Then, based on the position information of the carriage, an output such as voltage to be supplied to the main scanning motor is determined Based on the determined output, driving of the main scanning motor is controlled, with which speed and position control of the carriage are conducted. In such image forming apparatuses having the feedback control, upon detecting no input of encoder signal when the encoder conducts reading of the linear scale (i.e., input error), it is determined that abnormality occurs, and the carriage is stopped.

SUMMARY

In one aspect of the present invention, a driver apparatus is devised. The driver apparatus includes a drive unit to move a moveable unit along a given path using a drive force; a movement detector to detect movement of the moveable unit; a drive control unit to control the drive unit using a given output for a given time to drive the moveable unit; a determination unit to determine whether the movement detector detects a movement of the moveable unit for a given distance or more in a driving direction when the moveable unit is driven under a control of the drive control unit; and an abnormality detector to determine occurrence of abnormal when the determination unit determines that the moveable unit does not move the given distance or more.

In another aspect of the present invention, a method of controlling a driver apparatus is devised. The method includes the steps of 1) outputting a given voltage to a drive unit for a given time to move a moveable unit along a given path; 2) determining whether the moveable unit is moved for a given distance or more in a driving direction; 3) determining whether the given time elapses after starting the driving of the moveable unit; 4) returning a normal response when the determining step 2) determines that the moveable unit is moved for the given distance or more in the driving direction; and 5) returning an abnormal response indicating occurrence of abnormality when the determining step 3) determines that the given time elapses after starting the driving of the moveable unit.

In another aspect of the present invention, a method of controlling a driver apparatus is devised. The method includes the steps of 1) outputting a given voltage to a drive unit for a given time to move a moveable unit along a given path; 2) determining whether the moveable unit is moved for a given distance or more; 3) determining whether the moving direction is same as a driving direction when the determining step 2) determines that the moveable unit is moved for the given distance or more; 4) determining whether the given time elapses after starting the driving of the moveable unit when the determining step 2) determines that the moveable unit is not moved for the given distance or more; 5) returning a normal response when the determining step 3) determines that the moveable unit is moved in the driving direction; and 6) returning an abnormal response indicating occurrence of abnormality when the determining step 3) determines that the moving direction is not same as the driving direction or when the determining step 4) determines that the given time elapses after starting the driving of the moveable unit.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 4 is a flowchart showing steps of process of a carriage control by the main controller of FIG. 3 when power is ON;

Figure 1:
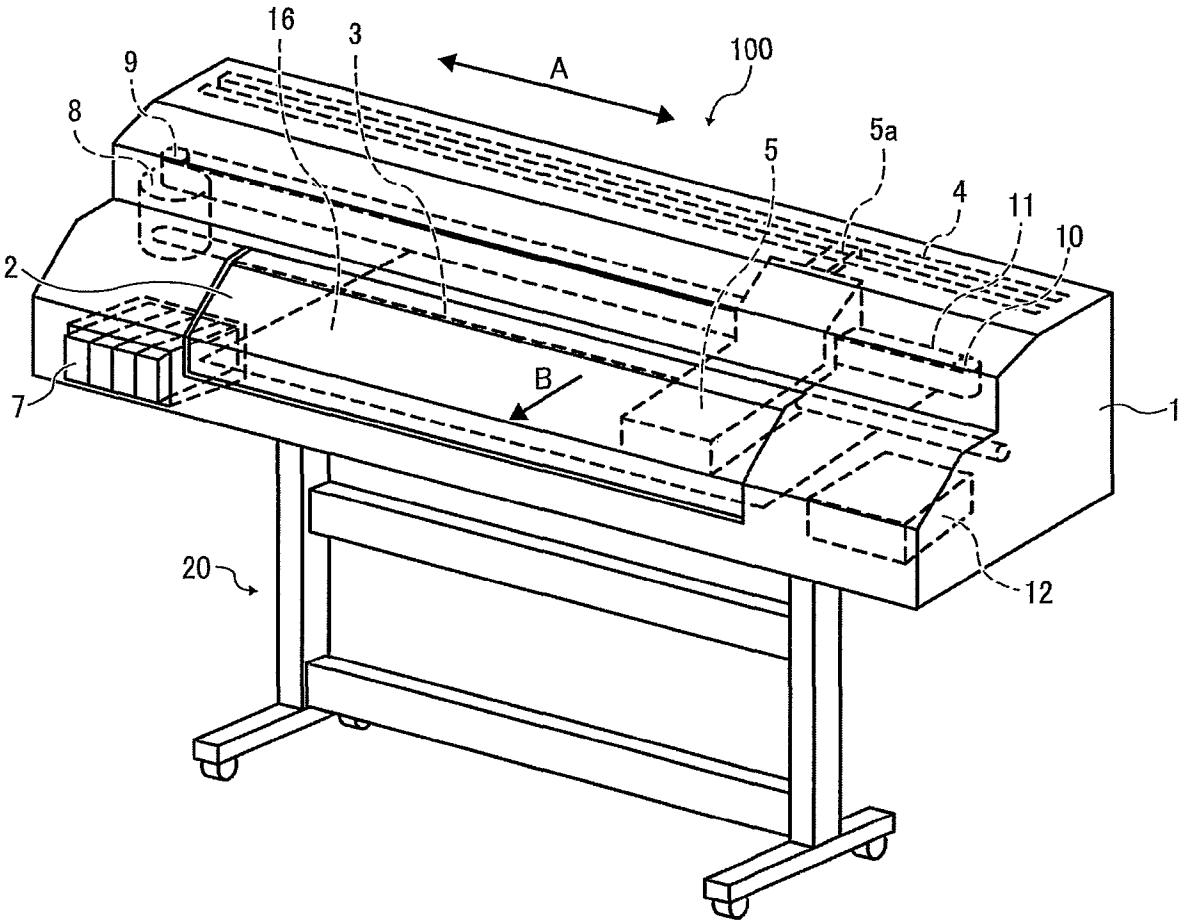
FIG. 1 is a schematic perspective view of an image forming apparatus using inkjet method and including a driver apparatus according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner and achieve a similar result. Referring now to the drawings, an apparatus or system according to an example embodiment is described hereinafter.

Figure 2:
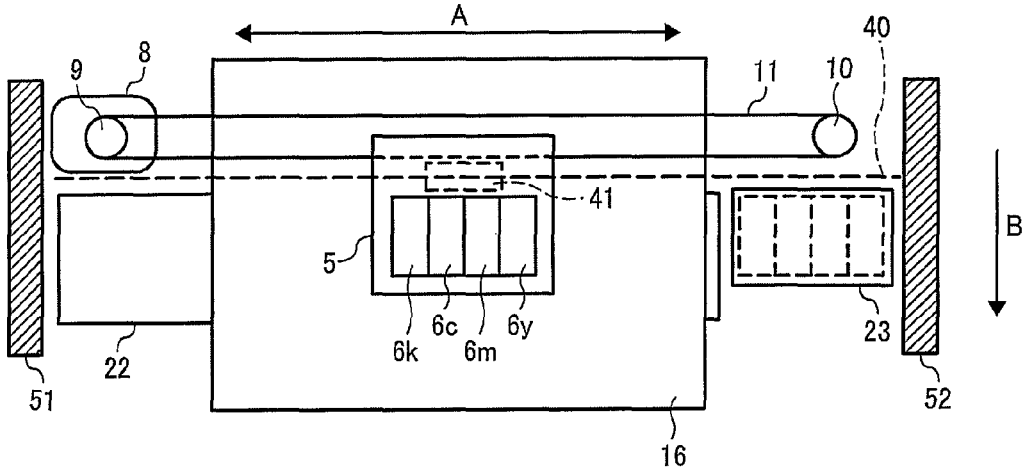
FIG. 2 is a schematic plan view of a mechanical configuration of the image forming apparatus of FIG. 1 having a carriage.

A description is given of an image forming apparatus 100 according to an example embodiment. The image forming apparatus 100 using the inkjet method includes a driver apparatus according to an example embodiment. FIG. 1 is a schematic perspective view of the image forming apparatus 100, and FIG. 2 is a schematic plan view of a mechanical configuration of the image forming apparatus 100 having a carriage therein.

As shown in FIG. 1, as to the image forming apparatus 100, a main housing 1 is disposed over a main frame 20. A main guide rod 3 and a sub-guide rod 4 are extended along the main scanning direction (arrow A direction) in the main housing 1. A carriage 5, which is an example of a moveable unit, is moveably supported on the main guide rod 3. The carriage 5 includes a link part 5*a* that engages the sub-guide rod 4 to stabilize the position of the carriage 5.

In the image forming apparatus 100, a timing belt 11, which is an endless belt, is extended along the main guide rod 3, and the timing belt 11 is extended by a drive pulley 9 and a driven pulley 10. The drive pulley 9 can be driven by a main scanning motor 8, and the driven pulley 10 is disposed in a way to set a given extension to the timing belt 11. When the drive pulley 9 is driven and rotated by the main scanning motor 8, the timing belt 11 can be moved along the main scanning direction depending on the rotation direction of the drive pulley 9.

The carriage 5 is linked to the timing belt 11. When the timing belt 11 is moved by the drive pulley 9 in the main scanning direction, the carriage 5 can be moved in a given path in the main scanning direction bi-directionally, which is along the main guide rod 3. The main scanning motor 8, the drive pulley 9, the driven pulley 10, and the timing belt 11 may be collectively used as a drive unit.

As shown in FIG. 2, the carriage 5 includes a recording head 6*y*, a recording head 6*m*, a recording head 6*c*, and a recording head 6*k* The recording head 6*y* dispenses yellow (Y) ink, the recording head 6*m* dispenses magenta (M) ink, the recording head 6*c* dispenses cyan (C) ink, and the recording head 6*k* dispenses black (K) ink. The recording heads 6*y*, 6*m*, 6*c*, 6*k* may be collectively referred to as the recording head 6. The recording head 6 is mounted on the carriage 5 while facing a dispensing face (nozzle face) to the downward (i.e., to the recording medium 16).

In the image forming apparatus 100, a cartridge unit 7 and a maintenance unit 12 are disposed at each end of the main scanning direction in the main housing 1. The cartridge unit 7 includes cartridges of yellow (Y), magenta (M), cyan (C), black (K) ink, and each cartridge is replaceable. Each of the cartridges of the cartridge unit 7 is connected with corresponding color recording heads 6*y*, 6*m*, 6*c*, 6*k* of the recording head 6 mounted on the carriage 5 via a tube. Ink is supplied from the cartridge to each of the recording heads 6*y*, 6*m*, 6*c*, 6*k* using the tube.

The image forming apparatus 100 outputs an image on the recording medium 16 by dispensing ink on the recording medium 16 transported intermittently in the sub-scanning direction (arrow B direction in FIG. 1) on a platen 22 (see FIG. 2), which is perpendicular to the main scanning direction, while moving the carriage 5 in the main scanning direction bi-directionally. Specifically, when the transportation of the recording medium 16 in the sub-scanning direction is stopped intermittently while the recording medium 16 is transported in the sub-scanning direction, the carriage 5, driven by the main scanning motor 8, moves in the main scanning direction along the main guide rod 3 and the sub-guide rod 4, and dispenses ink from the nozzles of the recording head 6 of the carriage 5 onto the recording medium 16 at a timing corresponding to image data to be formed onto the recording medium 16 on the platen 22.

The maintenance unit 12 conducts cleaning of the dispensing face of the recording head 6, capping of the recording head 6, and dispensing of ink to eject unnecessary ink from the recording head 6 and maintain the reliability of the recording head 6. The capping means an operation of engaging the ink head protection cap 23 (FIG. 2) onto the recording head 6 to prevent nozzle clogging of the recording head 6 due to drying of ink during power OFF.

The image forming apparatus 100 includes a cover 2 corresponding to the transport unit of the recording medium 16, wherein the cover 2 is an open-able cover. The cover 2 is opened when maintenance works is conducted and when jamming occurs to conduct maintenance works in the main housing 1 and to remove jammed recording medium 16.

A description is given of the carriage 5 and its peripheral configuration and its operation in the image forming apparatus 100 with reference to 1. In the image forming apparatus 100, a driving force of the main scanning motor 8 is transmitted to the carriage 5 via the timing belt 11, extended by the drive pulley 9 and the driven pulley 10, with which the carriage 5 can be moved bi-directionally in an area between a right wall 52 and a left wall 51 in an arrow A direction (main scanning direction) shown in FIG. 2. The carriage 5 dispenses ink from the nozzles of the recording head 6 while moving bi-directionally to form an image on the recording medium 16.

Further, when the carriage 5 moves, an encoder sensor 41 mounted on the carriage 5 reads an encoder sheet 40 (e.g., linear scale) disposed along the moving direction of the carriage 5. Marks are formed on the encoder sheet 40 along its long side direction (main scanning direction) with a given interval. Based on the reading of the encoder sheet 40, the encoder sensor 41 outputs encoder signals having a given pulse pattern. The encoder signals are input to a controller to be described later. The controller counts the pulse numbers to detect the position of the carriage 5, and obtains the position information of the carriage 5.

The platen 22 is disposed at a position facing the dispensing face of the recording head 6 mounted on the carriage 5. The platen 22 supports the recording medium 16 when dispensing ink to the recording medium 16 from the recording head 6. The recording medium 16 can be sandwiched by a transport roller driven by a sub-scanning motor, and transported on the platen 22 in the sub-scanning direction intermittently.

The recording medium 16 is fed from a sheet feed unit using a sheet feed motor, and is transported to a transport unit. The recording medium 16, transported to the transport unit, is transported in an arrow B direction (sub-scanning direction) to the platen 22 by the transport roller driven by a transport motor. The ink head protection cap 23 conducts a de-capping operation before starting the bi-directional moving of the carriage 5, with which an image can be formed. The de-capping means an operation of disengaging the ink head protection cap 23 from the recording head 6.

Figure 3:
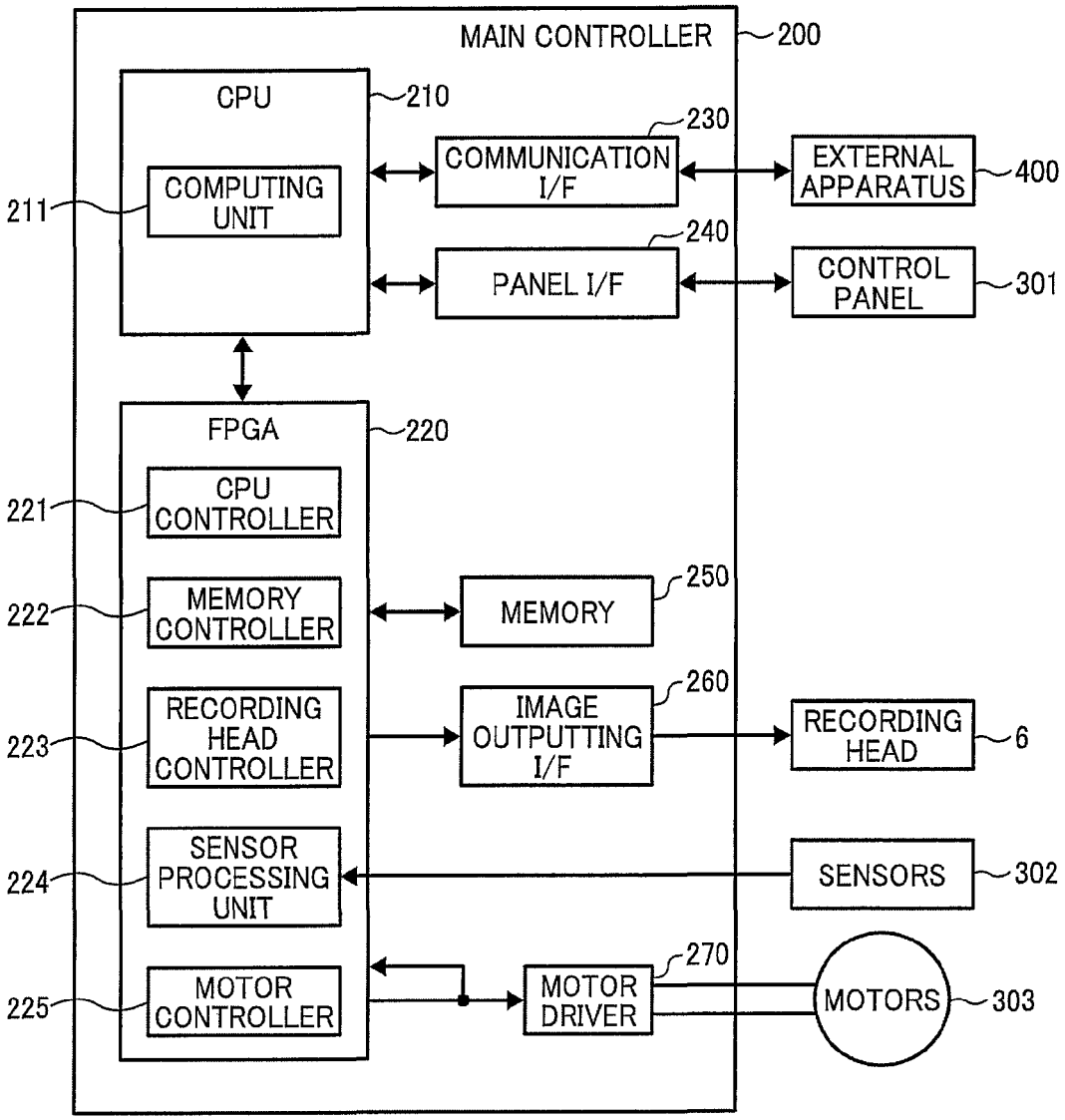
FIG. 3 is a block diagram of a main controller of the image forming apparatus of FIG. 1.

A description is given of a main controller of the image forming apparatus 100 with reference to FIG. 3, which is a block diagram of a main controller 200. The main controller 200 includes, for example, a central processing unit (CPU) 210, a field programmable gate array (FPGA) 220, a communication interface (I/F) 230, a panel interface (I/F) 240, a memory 250, an image outputting I/F 260, and a motor driver 270. The main controller 200 can include one or more FPGAs, in which one FPGA can be used as a drive control circuit, a determination circuit and an abnormality detection circuit, or different FPGAs can be used as a drive control circuit, a determination circuit and an abnormality detection circuit separately. The drive control circuit, the determination circuit and the abnormality detection circuit will be described later.

The CPU 210 is a micro computer having a read only memory (ROM) and a random access memory (RAM). The CPU 210 executes programs stored in the ROM using the RAM as a working area to control the image forming apparatus 100 as a whole. By executing the programs, the CPU 210 can implement a computing unit 211 that conducts various computing, and can communicate with an external apparatus 400 such as a personal computer (PC) via the communication I/F 230 and a network such as a local area network (LAN). Further, the CPU 210 can detect operations input to an operation unit of a control panel 301 via the panel I/F 240, and can display settings and operation conditions of the image forming apparatus 100 on a display unit disposed for the control panel 301.

Further, the CPU 210 can receive print data corresponding to print contents from the external apparatus 400, and can convert print data to color image data for an image drawing process. Further, the image data may be image data for monochrome image printing. Further, the CPU 210 can receive the print contents as image data. Then, the CPU 210 transfers the received or converted image data to the FPGA 220, and outputs the image data to the recording head 6 via the image outputting I/F 260 to print an image.

The FPGA 220, which is a programmable large scale integration (LSI), includes, for example, a CPU controller 221, a memory controller 222, a recording head controller 223, a sensor processing unit 224, and a motor controller 225. The CPU controller 221 conducts communication control with the CPU 210. The memory controller 222 conducts access control to the memory 250 under an instruction by the CPU 210. The memory 250 is a storage such as a flash memory (trademark) and a hard disk drive (HDD). The driver apparatus according an example embodiment can be configured with, for example, the drive unit and a control unit, wherein the drive unit includes, for example, the main scanning motor 8, the drive pulley 9, the driven pulley 10, the timing belt 11 as described above, and the control unit is a control circuit such as the FPGA 220.

Under an instruction of the CPU 210 and using position information of the carriage 5 to be described later, the recording head controller 223 outputs the received or converted image data to the recording head 6 of the carriage 5 via the image outputting I/F 260 to instruct the recording head 6 to conduct an image forming operation based on the image data. Among the received or converted image data, Y image data is output to the recording head 6*y*, M image data is output to the recording head 6*m*, C image data is output to the recording head 6*c*, and K image data is output to the recording head 6*k*.

The sensor processing unit 224 conducts processing of signals received from various sensors 302 such as the encoder sensor 41. Under an instruction of the CPU 210, the motor controller 225 controls driving of various motors 303 such as the main scanning motor 8 and a sub-scanning motor via the motor driver 270. The various motors 303 employ, for example, a direct current (DC) motor, a stepping motor or the like.

A description is given of a feedback control by the sensor processing unit 224 and the motor controller 225. Under an instruction of the CPU 210, the motor controller 225 drives the main scanning motor 8, and the main scanning motor 8 moves the carriage 5 in the main scanning direction, in which the encoder sensor 41 reads the encoder sheet 40 (e.g., linear scale). An encoder signal output from the encoder sensor 41 is input to the sensor processing unit 224.

The sensor processing unit 224 counts the pulse numbers of the encoder signal, input from the encoder sensor 41. Based on the counted pulse numbers, the sensor processing unit 224 detects a position, moving speed and a moving direction of the carriage 5, and outputs such information to the motor controller 225. Therefore, the encoder sensor 41 and the sensor processing unit 224 can be collectively used as a movement detector.

The motor controller 225 obtains information of position, moving speed and moving direction of the carriage 5 from the sensor processing unit 224, and determines an output of the main scanning motor 8 (e.g., driving power and driving direction) based on such information. Then, based on the determined output of the main scanning motor 8, the motor controller 225 controls driving of the main scanning motor 8 to conduct speed control and positional control of the carriage 5.

Figure 4:
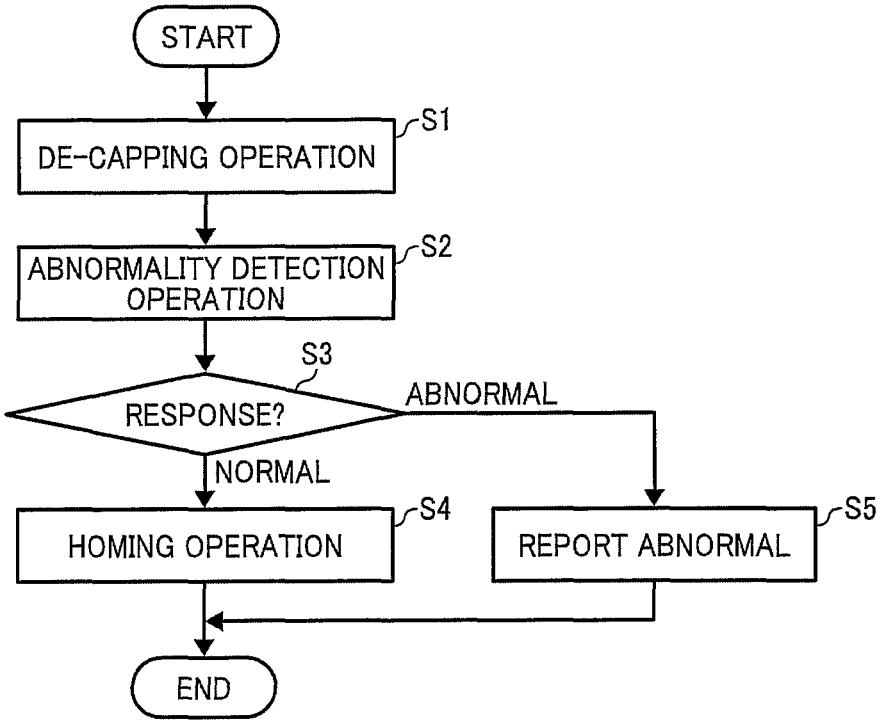

A description is given of operation control of the carriage 5 by the main controller 200 shown in FIG. 3. A description is given of a control of the carriage 5 by the main controller 200 when the power is turned ON normally. FIG. 4 is a flowchart showing steps of process for the carriage 5 when the power is turned ON.

The CPU 210 of the main controller 200 starts the process of FIG. 4 when the power is turned ON. At step S1, the CPU 210 instructs the FPGA 220 to conduct the de-capping operation. Because the carriage 5 is not driven when the carriage 5 is under the capped condition, the main controller 200 conducts the de-capping operation when the carriage 5 is driven. Upon completing the de-capping operation, the CPU 210 instructs the FPGA 220 to conduct the abnormality detection operation at step S2.

The abnormality detection operation will be described later. The abnormality of drive control of the carriage 5 can be detected by checking whether an input value (pulse numbers of encoder signal) input to the sensor processing unit 224 has abnormal condition or not before the carriage 5 is operated by the feedback control. Upon completing the abnormality detection operation, the CPU 210 receives a response from the FPGA 220, and determines the response at step S3. If the response is a normal response that indicates no abnormality occurs, the CPU 210 instructs the FPGA 220 to conduct a homing operation of the carriage 5 at step S4, and then ends the process of FIG. 4.

The homing operation of the carriage 5 is an initializing process when moving the carriage 5. For example, when a current position of the carriage 5 is deviated from a given capping position (waiting position), the CPU 210 instructs the FPGA 220 to rotate the main scanning motor 8 to correct the positional deviation of the carriage 5 (an instruction of positional control). The homing operation can be conducted normally when the CPU 210 receives the normal response from the FPGA 220 during the abnormality detection operation.

By contrast, if the response at step S3 is an abnormal response indicating that abnormal is detected, a message that that abnormality occurs to the drive control of the carriage 5 is reported to a user at step S5, and ends the process. This reporting can be conducted various ways such as displaying a message and/or image on the control panel 301, outputting light and sound, and sending e-mail to a given address. At step S5, the CPU 210 can be used as a reporting unit.

Figure 5:
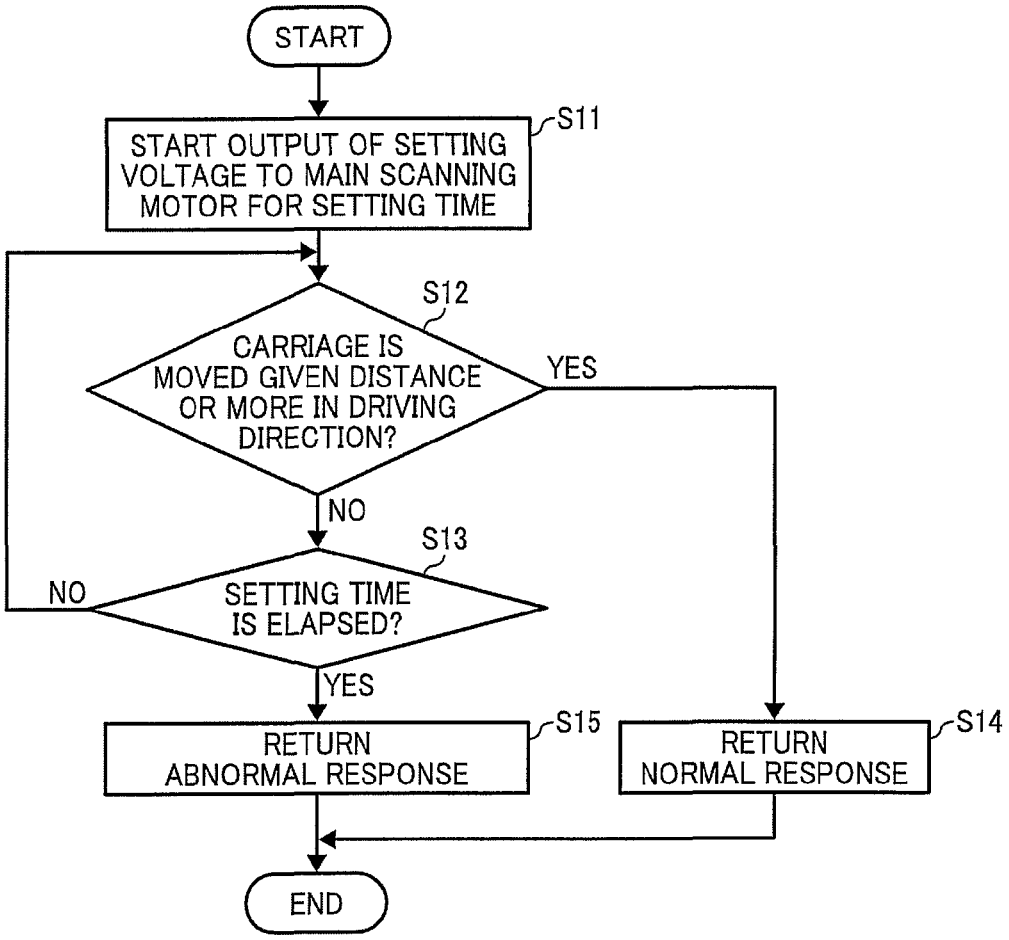
FIG. 5 is a first example flowchart showing steps of process of an abnormality detection operation by a FPGA shown in FIG. 3.

FIG. 5 is a first example flowchart showing steps of process of the abnormality detection operation conducted by the FPGA 220 when instructed at step S2 of FIG. 4. Table 1 shows example setting conditions set to the FPGA 220 in advance for the first example.

TABLE 1

| Setting voltage | Setting time | Threshold |
|---|---|---|
| +3 V | 200 ms | Two pulses |

The setting conditions include, for example, setting voltage, setting time, and threshold. The setting voltage is a value of voltage output (i.e., given voltage output) to the main scanning motor 8 used for the abnormality detection operation. In this example case, +3V is set. A moving direction of the carriage 5 changes depending on positive or negative of voltage. For example, when the voltage is plus (+), the carriage 5 is moved to a first direction (which may be also referred to as an outward direction), and when the voltage is minus (−), the carriage 5 is driven or moved to a second direction (which may be also referred to as homeward direction). Further, the greater the absolute value of voltage, the greater driving force is applied to move the carriage 5.

The setting time is a value of time used for outputting the setting voltage to the main scanning motor 8. In this example case, 200 ms (milliseconds) is set.

The threshold is a value corresponding to a given distance movement of the carriage 5, which is compared with a value of an encoder signal (pulse numbers) output from the encoder sensor 41, when outputting the setting voltage to the main scanning motor 8. In this example case, the threshold is set to two pulses. The threshold is set with a value corresponding to a distance which becomes smaller than a distance of the carriage 5 that is to be moved when the setting voltage is applied to the main scanning motor 8 for the setting time.

To prevent error detection at a place where the load becomes heavy, the setting time is set with a value having a margin so that the carriage 5 can be moved for a distance greater than the threshold. Further, the setting voltage is set with a value that can satisfy an activation torque effectively, and set the value having an enough margin in view of aging of sliding parts of the machine. However, a greater voltage may cause damages to the carriage 5 when the carriage 5 impacts the wall. Therefore, the setting voltage is selected in view of the margin and the impact effect to the machine.

Upon receiving an instruction of the abnormality detection operation from the CPU 210, the FPGA 220 starts the abnormality detection operation of FIG. 5 using the motor controller 225. In this process, at step S11, the FPGA 220 instructs the motor driver 270 to start an operation of outputting the setting voltage (e.g., +3V of Table 1) to the main scanning motor 8 for the setting time (e.g., 200 ms of Table 1), with which the main scanning motor 8 is controlled to drive the carriage 5 for the setting time.

Further, the FPGA 220 conducts the following process using the sensor processing unit 224 and the motor controller 225. At step S12, the FPGA 220 determines whether the carriage 5 is moved for a given distance or more in the driving direction (e.g., first direction (outward direction) in Table 1), wherein the sensor processing unit 224 detects the carriage 5. Specifically, the FPGA 220 determines or monitors whether a change of encoder signal (input value), input to the encoder sensor 41, is the threshold (e.g., two (2) pulses in Table 1) or more in the driving direction.

If the carriage 5 is moved for the given distance or more at step S12, the FPGA 220 determines that the drive control of the carriage 5 is normal, and returns a normal response to the CPU 210 at step S14, and ends the process of FIG. 5 because this result means that the carriage 5 is moved in line with design of the apparatus based on the voltage applied to the main scanning motor 8.

If the carriage 5 is not moved for the given distance or more at step S12, at step S13, the FPGA 220 determines whether the setting time of Table 1 elapses after starting the driving of the carriage 5 at step S11. If the setting time does not elapse (S13: NO), the FPGA 220 repeats the process from step S12.

If the setting time elapses (S13: YES), the FPGA 220 determines that the drive control of the carriage 5 is abnormal, and returns a abnormal response to the CPU 210 at step S15, and ends the process of FIG. 5 because this result means that the carriage 5 is not moved substantially (i.e., the carriage 5 is not moved in line with design of the apparatus even if the voltage is applied to the main scanning motor 8).

As long as the determination at steps S12 and S13 is NO, the FPGA 220 repeats the process of steps S12 and S13 with a given control frequency such as 1 KHz, in which the determination at steps S12 and S13 are conducted each 1 ms. Therefore, if the setting time is 200 ms, the determination at steps S12 and S13 is conducted for 200 times as a maximum. If the determination at step S12 becomes YES during the 200 times, it is assumed to detect that the carriage 5 is moved for the given distance or more in the driving direction during the setting time of driving the carriage 5. In the above process, the FPGA 220 can function as a drive control unit or drive control circuit at step S11, and can function as a determination unit and an abnormality detector at steps S12 and S13. In an example embodiment, one FPGA can be used as the drive control circuit, the determination circuit and the abnormality detection circuit, or different FPGAs can be used as the drive control circuit, the determination circuit, and the abnormality detection circuit separately.

In the above process, the FPGA 220 controls the main scanning motor 8 with a given output and a given time to drive the carriage 5, in which based on whether detecting the carriage 5 is moved for the given distance or more in the driving direction, the FPGA 220 can determine whether the drive control of the carriage 5 is normal or abnormal.

Further, this normal or abnormal determination can be conducted at a timing which is different from a driving timing of the carriage 5 for printing.

Further, the moving distance of the carriage 5 can be set smaller by setting an adequate voltage output and adequate time, with which the risk of impacting the carriage 5 to the wall can be reduced, and it can determine whether the drive control of the carriage 5 is normal or abnormal.

The given distance can be set based on pulses detectable by the encoder sensor 41, in which one (1) pulse can be set as a minimum unit for detecting the movement of the carriage 5, and a multiplication of the minimum unit can be used for detecting the movement of the carriage 5. For example, in case of Table 1, the given distance is set two (2) pulses (i.e., two times of minimum unit) of the encoder sensor 41, but the given distance can be set to one (1) pulse (i.e., minimum unit). The given distance is preferably set a shorter distance in view of preventing and mitigating impact effect when an impact of the carriage 5 occurs.

Further, in case of the breaking of a wire, the carriage 5 does not move, in which the normal or abnormal determination be conducted using one pulse. However, if the one pulse is used as a reference value and the carriage 5 moves due to vibrations or the like without a driving of the main scanning motor 8, an error determination may occur. Therefore, if the probability of error determination cannot be ignored, two pulses may be used. If the moving distance of the carriage 5 due to vibrations may be two pulses or more, a greater pulse number can be set.

A description is given of starting position of the abnormality detection operation by the motor controller 225, in which the carriage 5 may be at a plurality of starting positions. The setting voltage of the FPGA 220 is set to, for example, +3V or −3V.

Figure 6:
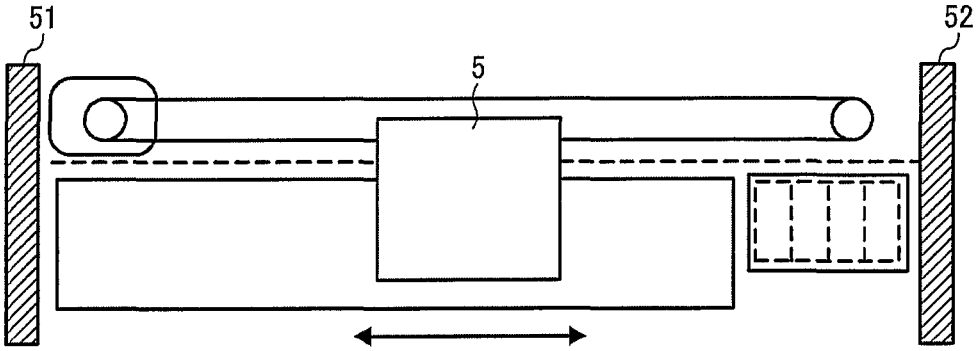
FIG. 6 shows a first example position of a carriage when the abnormality detection operation by the motor controller shown in FIG. 3 is started.

FIG. 6 shows a first example position of the carriage 5 when the abnormality detection operation is started using the motor controller 225. When the apparatus is retuned from a jamming (JAM) correction process or abnormal correction process, the position of the carriage 5 may not be identified in some cases.

For example, as shown in FIG. 6, the abnormality detection operation may be conducted when the carriage 5 is positioned near a center of the main housing 1. As above described, a moving area of the carriage 5 is between the left wall 51 and the right wall 52 of the main housing 1. When the motor controller 225 outputs the setting voltage of +3V to the main scanning motor 8 under this condition, the carriage 5 can be moved along the main scanning direction in the first direction (outward direction or leftward direction in FIG. 6).

By contrast, when the motor controller 225 outputs the setting voltage of −3V to the main scanning motor 8 under this condition, the carriage 5 can be moved along the main scanning direction in the second direction (homeward direction or rightward direction in FIG. 6).

The sensor processing unit 224 determines whether a change of an input value, input from the encoder sensor 41, is the threshold of two pulses or more when the carriage 5 is driven.

If the encoder sensor 41 has a resolution of 1200 line per inch (lpi), the change of two pulses or more of the input value corresponds to about 42 μm-movement of the carriage 5. Further, even after the voltage output to the main scanning motor 8 is stopped, the carriage 5 moves further for a few pulses or more by inertia.

Figure 7:
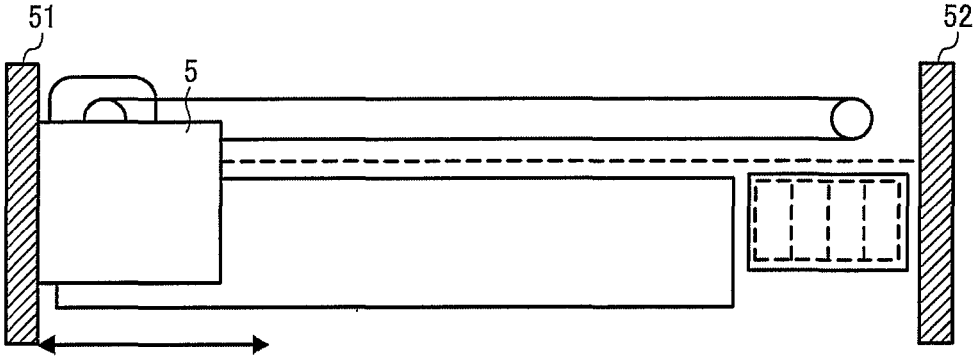
FIG. 7 shows a second example position of a carriage when the abnormality detection operation by the motor controller shown in FIG. 3 is started.

FIG. 7 shows a second example position of the carriage 5 when the motor controller 225 starts the abnormality detection operation. As shown in FIG. 7, the power is turned ON when the carriage 5 is being contacted to the left wall 51 of the main housing 1 and then the abnormality detection operation is conducted.

When the motor controller 225 outputs the setting voltage of −3V to the main scanning motor 8 under this condition, the carriage 5 can be moved along the main scanning direction in the second direction (homeward direction or rightward direction in FIG. 7). However, when the motor controller 225 outputs the setting voltage of +3V to the main scanning motor 8 under this condition, the carriage 5 cannot be moved to the first direction (outward direction or leftward direction in FIG. 7) because the carriage 5 is being contacted to the left wall 51. Therefore, even if the driving operation for moving the carriage 5 is normally conducted, the FPGA 220 cannot detect the given distance movement of the carriage 5 correctly.

Figure 8:
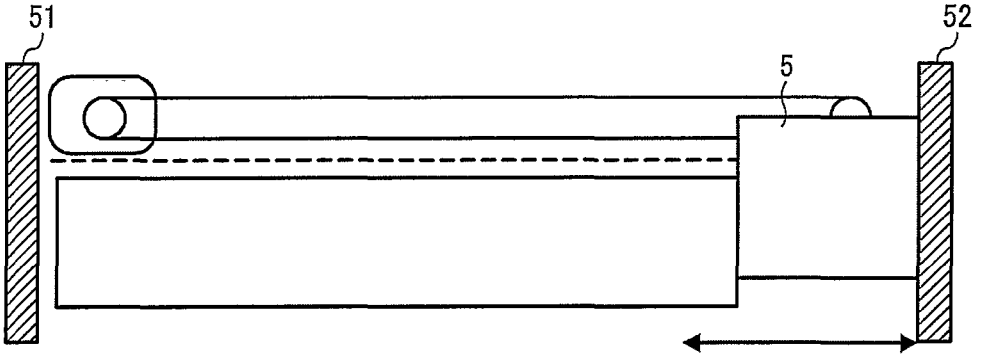
FIG. 8 shows a third example position of a carriage when the abnormality detection operation by the motor controller shown in FIG. 3 is started.

Further, as shown in FIG. 8, the power is turned ON when the carriage 5 is being contacted to the right wall 52 of the main housing 1 and then the abnormality detection operation is conducted.

When the motor controller 225 outputs the setting voltage of +3V to the main scanning motor 8 under this condition, the carriage 5 can be moved along the main scanning direction in the first direction (outward direction or leftward direction in FIG. 8). However, when the motor controller 225 outputs the setting voltage of −3V to the main scanning motor 8 under this condition, the carriage 5 cannot be moved to the second direction (homeward direction or rightward direction in FIG. 8) because the carriage 5 is being contacted to the right wall 52. Therefore, even if the driving operation for moving the carriage 5 is normally conducted, the FPGA 220 cannot detect the given distance movement of the carriage 5 correctly.

The situation that the correct detection cannot be conducted can be prevented by moving the carriage 5 in the first direction (outward direction) at first and then moving the carriage 5 in the second direction (homeward direction, or by moving the carriage 5 in the second direction (homeward direction) at first and then moving the carriage 5 in the first direction (outward direction). These movements will be described later with reference to FIG. 9.

Further, the carriage 5 may be positioned near the left wall 51 or the right wall 52 while not contacted the left wall 51 or the right wall 52. In such a case, if the carriage 5 is moved toward the wall greatly, the carriage 5 may impact to the wall, and the carriage 5 may be pushed into the wall. Therefore, the voltage output and the output time to the main scanning motor 8 may be set smaller.

Further, in the process of FIG. 5, if it is determined YES at step S12 (if the given distance movement is detected), the voltage output to the main scanning motor 8 can be stopped at this timing without waiting the elapsing of the setting time. With this configuration, the moving distance of the carriage 5 can be within a total of the given distance and inertia movement, by which the impact to the wall and the pushing into the wall can be prevented effectively. The impact means a condition that the carriage 5 impacts the left wall 51 or the right wall 52 from a distanced position.

If the carriage 5 is being contact to the left wall 51 or the right wall 52 from the beginning, and the carriage 5 is driven toward the wall, the carriage 5 does not move at all. Therefore, if it is determined NO at step S12, in which the pushing of the carriage 5 into the wall occurs, but the carriage 5 does not impact the wall.

Figure 9:
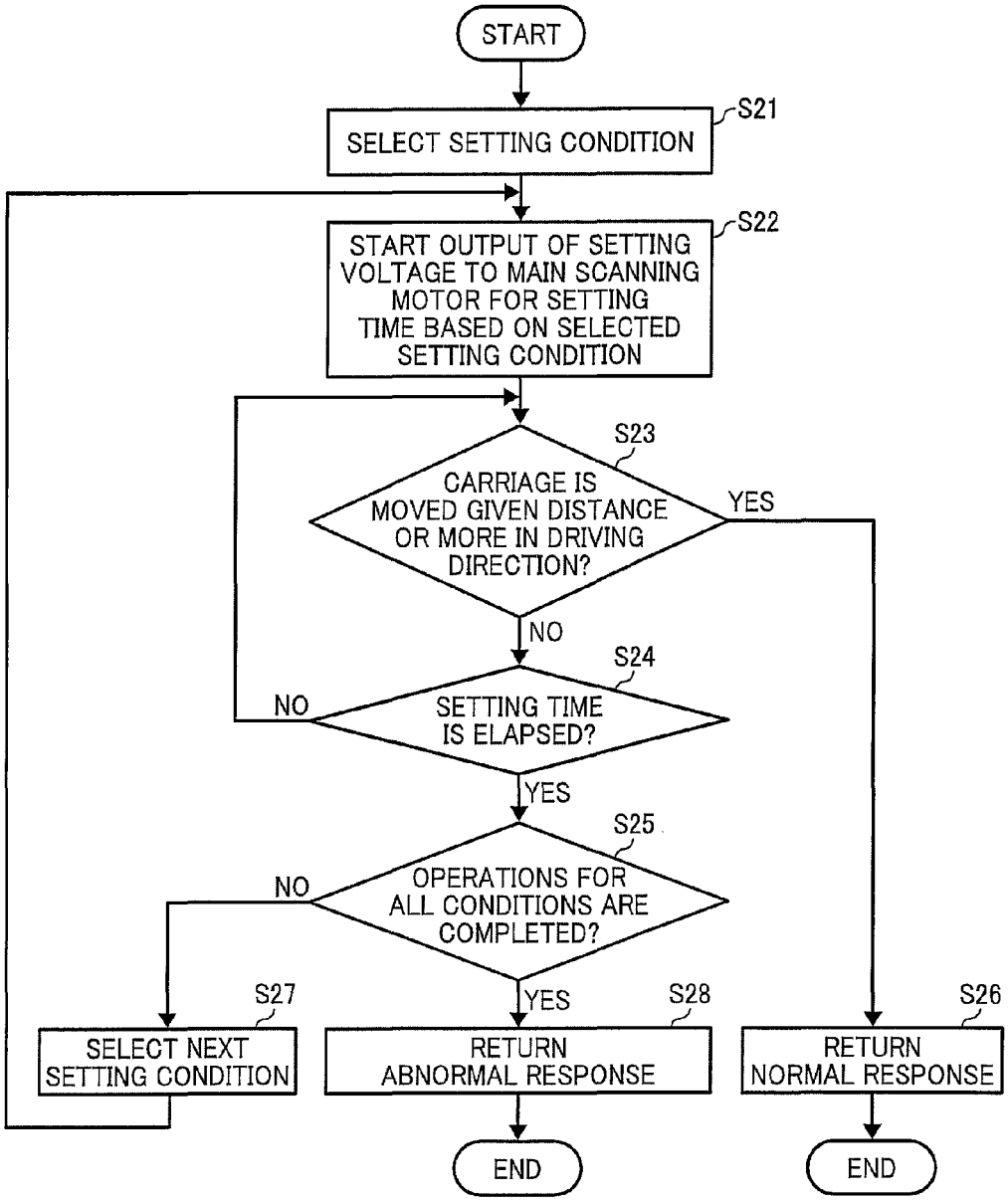
FIG. 9 is a second example flowchart showing steps of process of an abnormality detection operation by the FPGA shown in FIG. 3.

FIG. 9 is a second example flowchart showing steps of the abnormality detection operation conducted by the FPGA 220. Table 2 shows setting conditions set to the FPGA 220 in advance used for the abnormality detection operation of FIG. 9 of the second example.

TABLE 2

| ID | Setting voltage | Setting time | Threshold |
|---|---|---|---|
| 1 | +3 V | 200 ms | Two pulses |
| 2 | −3 V | 200 ms | Two pulses |
| 3 | +7 V | 200 ms | Two pulses |
| 4 | −7 V | 200 ms | Two pulses |

As indicated in Table 2, in this second example, the abnormality detection operation is conducted step by step using different setting conditions, and Table 2 shows a plurality of setting conditions. The meaning of the setting voltage, the setting time and threshold of each setting condition are the same as Table 1. ID is identification information to identify each setting condition. In Table 2, the setting time of every ID is 200 ms, and the threshold of each ID is two (2) pulses. The setting voltage is set +3V for ID=1, −3V for ID=2, +7V for ID=3, and −7V for ID=4.

As to the setting voltage, ID=1 is set with plus (+) voltage, and ID=2 is set with minus (−) voltage to prevent the problems explained with FIGS. 7 and 8, in which when the movement of the carriage 5 cannot be detected in one driving direction, the carriage 5 can be moved in the opposite direction.

As to the setting voltage, the setting voltage is increased to 7V for ID=3 and ID=4 in a case that the carriage 5 cannot be driven effectively with 3V due to the over-the-time change, temperature, machine difference or the like, in which if the movement of the carriage 5 cannot be detected with 3V-drive, the carriage 5 can be driven with a greater voltage output.

Upon receiving an instruction of the abnormality detection operation from the CPU 210, the FPGA 220 starts the abnormality detection operation of FIG. 9 using the motor controller 225. In this process, the FPGA 220 selects one setting condition from the setting conditions set in Table 2 at step S21. For example, the FPGA 220 selects the smallest ID among the IDs at first, and then selects IDs from the smallest ID to largest ID.

At step S22, based on the selected setting condition, the FPGA 220 starts an operation to output the setting voltage to the main scanning motor 8 for the setting time using the motor driver 270. In case of Table 2, because the setting condition of ID=1 is selected at first, +3V is output for 200 ms to move the carriage 5 in the first direction (outward direction).

Further, as same as steps S12 and S13 of FIG. 5, at steps S23 and S24, the FPGA 220 determines whether the carriage 5 is moved for the given distance or more in the driving direction when the carriage 5 is driven for the setting time. If it is determined YES at step S23 within the setting time, the process proceeds to step S26, and the FPGA 220 returns a normal response to the CPU 210 as same as step S14 of FIG. 5, and ends the process of FIG. 9.

If the setting time elapses (step S24: YES), the process proceeds to step S25, in which it is determined whether operations at steps S22 to S24 are completed for all of the setting conditions set in advance. If it is determined NO at step S25, it means one or more setting conditions still remain, and then a next setting condition is selected at step S27, and the FPGA 220 repeats the process from step S22.

If it is determined YES at step S25, it means that it cannot be determined that the drive control of the carriage 5 is normal even if all of the setting conditions are applied. Then, the FPGA 220 determines that the drive control of the carriage 5 is abnormal, and returns an abnormal response to the CPU 210 at step S28, and ends the process of FIG. 9.

For example, under a condition that the setting condition shown in Table 2 is set, when the FPGA 220 does not detect the movement of the carriage 5 for the given distance or more in the driving direction when the carriage 5 is driven based on the setting condition of ID=1, the FPGA 220 drives the carriage 5 in the opposite direction based on the setting condition of ID=2. Therefore, when the carriage 5 cannot be moved in one direction due to an obstacle such as a wall as shown in FIG. 7 and FIG. 8 when the carriage 5 is driven, the movement of the carriage 5 can be detected by driving the carriage 5 in the opposite direction.

Further, if the movement of the carriage 5 for the given distance or more in the driving direction is not detected when the carriage 5 is driven based on the setting conditions of ID=1 and ID=2, the carriage 5 is driven with a greater voltage output based on the setting conditions of ID=3 and ID=4. Therefore, if the carriage 5 cannot be driven effectively using the initial voltage output due to over-the-time change, temperature, machine difference, the carriage 5 can be driven effectively with the greater voltage output, with which the movement of the carriage 5 can be detected.

The setting conditions used for inspection shown in Table 2 may preferably set a driving power smaller than a driving power for a normal image forming operation to set the moving distance of the carriage 5 as small as possible. Therefore, the carriage 5 may not be moved effectively when the setting condition for inspection having a smaller driving power is applied. In this case, the carriage 5 can be driven using the greater voltage output such as the voltage output of ID=3 and ID=4.

Figure 10:
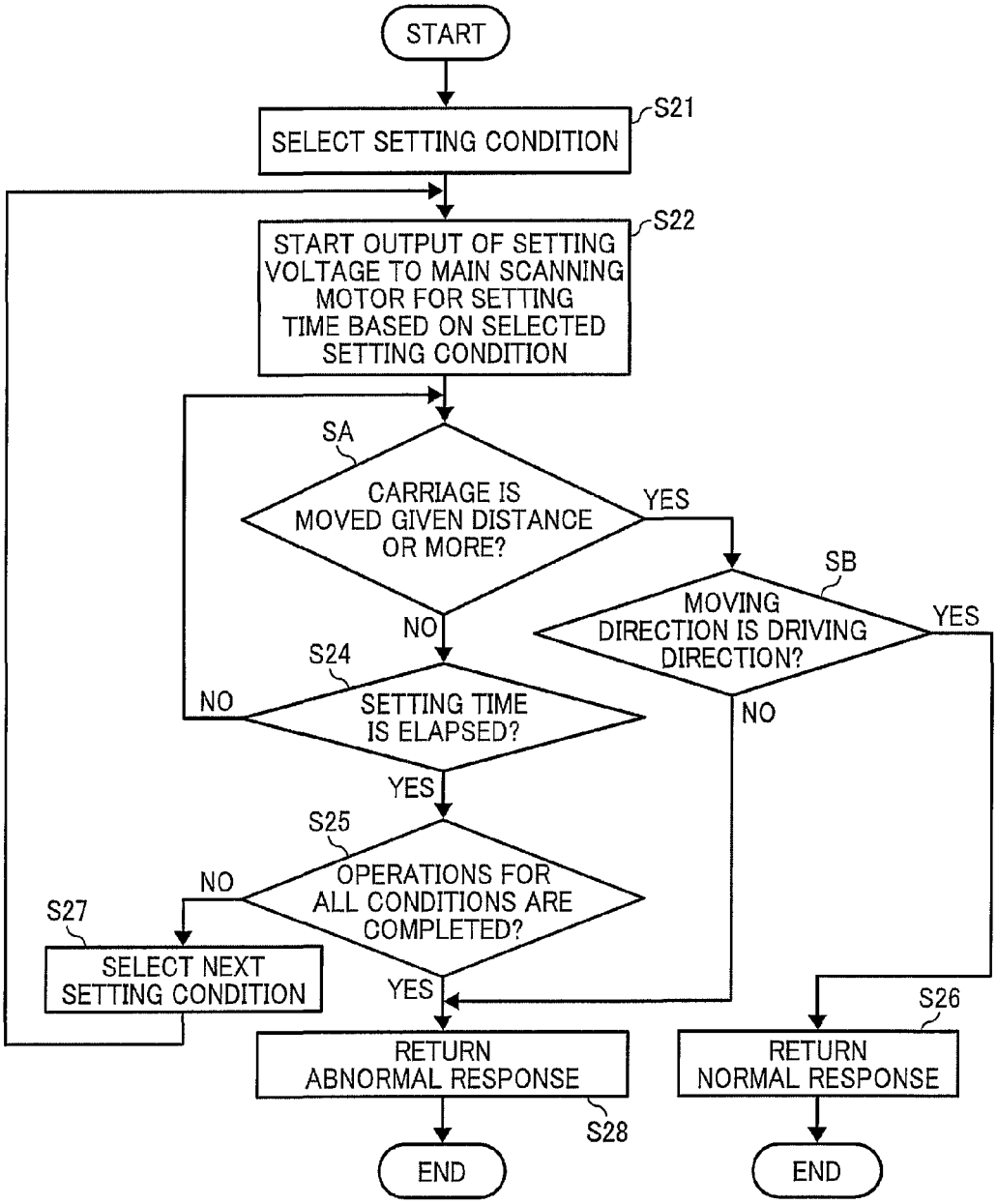
FIG. 10 is a third example flowchart showing steps of process of an abnormality detection operation by the FPGA shown in FIG. 3.

FIG. 10 is a third example flowchart showing steps of the abnormality detection operation conducted by the FPGA 220. Compared to the second example, in the third example, when the carriage 5 is moved to a direction opposite to a driving direction, the abnormal response is returned immediately. Therefore, this point alone is described for the third example. The process of FIG. 10 is almost same as the process of FIG. 9, but instead of step S23 of FIG. 9, the FPGA 220 conducts a determination at step SA of FIG. 10, in which the FPGA 220 determines whether the carriage 5 moves a given distance or more without consideration to the movement direction of the carriage 5.

If step SA is YES, the process proceeds to step SB, in which the FPGA 220 determines whether the moving direction of the carriage 5 is same as the driving direction of the main scanning motor 8. If the moving direction is same as the driving direction (step SB: YES), the FPGA 220 determines that the drive control of the carriage 5 is normal as same as step S23 (YES) of FIG. 9, and the FPGA 220 returns a normal response to the CPU 210 at step S26, and ends the process of FIG. 10.

By contrast, if the moving direction is not same as the driving direction (step SB: NO), the FPGA 220 determines that the carriage 5 is moving in a direction different from the designed direction, and determines that the drive control of the carriage 5 is not conducted normally. Then, the FPGA 220 returns an abnormal response to the CPU 210 at step S28, and ends the process of FIG. 10. If step SA is NO, the process proceeds to step S24 as same as step S23 (NO) of FIG. 9.

In the above described process, if the carriage 5 moves to a direction different from the designed direction, it can quickly determine that the carriage 5 moves abnormally. Further, if the driving of the carriage 5 is stopped immediately right after step SA is determined YES, an impact of the carriage 5 to the wall due to the unexpected movement of the carriage 5 can be prevented effectively.

When the FPGA 220 returns the abnormal response to the CPU 210 at step S28, the following two abnormal responses (a) and (b) may be returned.

(a) When an abnormal response is issued after completing step S25, which determines that operations for all of the setting conditions have completed, it is determined that the output of drive signal to the main scanning motor 8 is abnormal.

(b) When an abnormal response is issued after completing step SB, which determines that the moving direction is abnormal, it is determined that the moving direction of the carriage 5 is abnormal.

Further, in case of (a), the movement of the carriage 5 cannot be detected effectively due to the breaking of a wire that may occur to the encoder input, and in case of (b), the movement of the carriage 5 cannot be detected due to a connector error that may occur to the encoder sensor 41. Therefore, when the CPU 210 reports abnormality to a user based on the abnormal response from the FPGA 220, or conducts others based on the abnormal response from the FPGA 220, the possibility of wire breaking and connector error may be considered.

Figure 11:
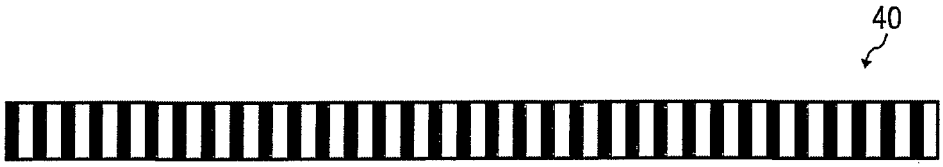
FIG. 11 shows a configuration of an encoder sheet shown in FIG. 2.
Figure 12:
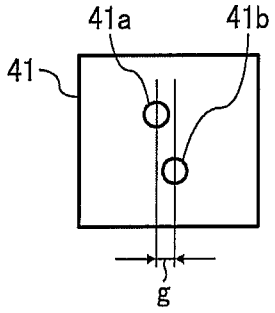
FIG. 12 shows a positional relation of sensor elements on a detection face of an encoder sensor of FIG. 2.
Figure 13:
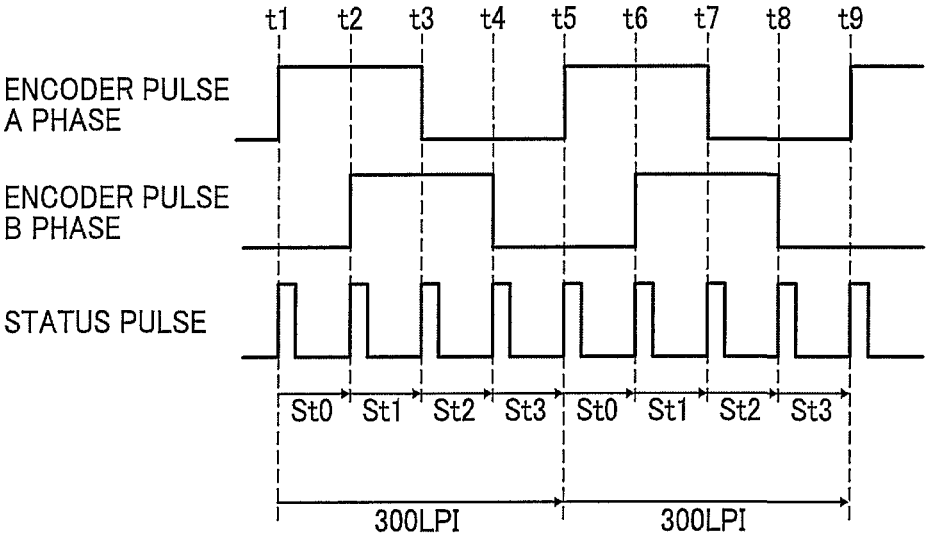
FIG. 13 is an example timing chart showing timing of encoder pulses, which are detection signals of surface of the encoder sheet detected by the sensor elements, and count-up timing of a four multiplication (1200 LPI) up-down counter.

A description is given of a scheme of determination at step SB by the FPGA 220 (determination whether the moving direction is same as the driving direction) using an encoder signal output from the encoder sensor 41 with reference to FIGS. 11 to 13. FIG. 11 is a schematic view of the encoder sheet 40 of FIG. 2. FIG. 12 shows a positional relationship of sensor elements on a detection face of the encoder sensor 41 of FIG. 2.

For example, as shown in FIG. 11, the encoder sheet 40 is formed with marks (e.g., black lines) along its long side or the main scanning direction (i.e., moving direction of the carriage 5) with a given interval. For example, black lines and white lines are alternately formed. As shown in FIG. 12, the encoder sensor 41 includes, for example, two sensor elements 41*a* and 41*b*. The two sensor elements 41*a* and 41*b* are disposed by setting a gap "g" with each other in the main scanning direction, wherein the black lines and white lines are alternately formed on the encoder sheet 40 along the main scanning direction as shown in FIG. 11.

With this configuration, the sensor element 41*a* and the sensor element 41*b* detect the encoder signal (encoder pulse), which is a detection signal of surface of the encoder sheet 40, at different timing corresponding to the gap "g" shown in FIG. 12. In an example embodiment, for example, the sensor processing unit 224 (FIG. 3) includes a four multiplication (1200 LPI) up-down counter for A phase and B phase of the encoder signal (encoder pulse). The four multiplication up-down counter includes two 300 LPI counters and one status counter.

FIG. 13 is an example timing chart showing timing of encoder pulses, which are detection signals of surface of the encoder sheet 40 detected by the sensor elements 41*a* and 41*b*, and count-up timing of the four multiplication (1200 LPI) up-down counter. In FIG. 13, the detection signal by the sensor element 41*a* is referred to as encoder pulse A phase, and the detection signal by the sensor element 41*b* is referred to as encoder pulse B phase.

As shown in timing t1 of FIG. 13, when the sensor element 41*a* in the encoder sensor 41 is in a condition to read the black line while the carriage 5 moves in one direction in the main scanning direction, the encoder pulse A phase rises. Further, when the sensor element 41*b* is in a condition to read the black line, the encoder pulse B phase rises.

The encoder pulse A phase is input to one 300 LPI counters, and the 300 LPI counter counts when the encoder pulse A phase rises. The encoder pulse B phase is input to another 300 LPI counter, and another 300 LPI counter counts when the encoder pulse B phase rises. The encoder pulse A phase and the encoder pulse B phase are also input the status counter, and the status counter counts when the encoder pulse A phase and the encoder pulse B phase rise and go down.

The counting direction is determined based on a phase difference between the A phase and the B phase. When the A phase is ahead of the B phase, each counter conducts an up-counting. When the A phase is behind the B phase, each counter conducts a down-counting. Therefore, the count value of the four multiplication up-down counter (status counter actually) increases when the carriage 5 moves in the first direction (outward direction), and decreases when the carriage 5 moves in the second direction (homeward direction).

In this configuration, when the carriage 5 is moved in the first direction (outward direction), the FPGA 220 stores a count value (e.g., 100) when the movement is started, and the FPGA 220 subtracts the count value when the movement is started from a count value after the movement (e.g., 110) to determine a moving distance based on an absolute value of the subtraction result. Further, the FPGA 220 can determine the moving direction based on the positive or negative of value. For example, the positive value is set in the first direction (outward direction), and the negative is set in the second direction (homeward direction), but the positive value can be in the second direction (homeward direction) and the negative value is can be in the first direction (outward direction).

When the count value exceeds a given value with respect to a start position of the movement of the carriage 5 such as when the count value exceeds the threshold from the start position of the movement of the carriage 5, the FPGA 220 can determine the moving direction of the carriage 5 by checking whether the subtracted value (logical value) is positive or negative. The above detection method is one example of detecting the moving distance and the moving direction, and other methods can be used.

Figure 14:
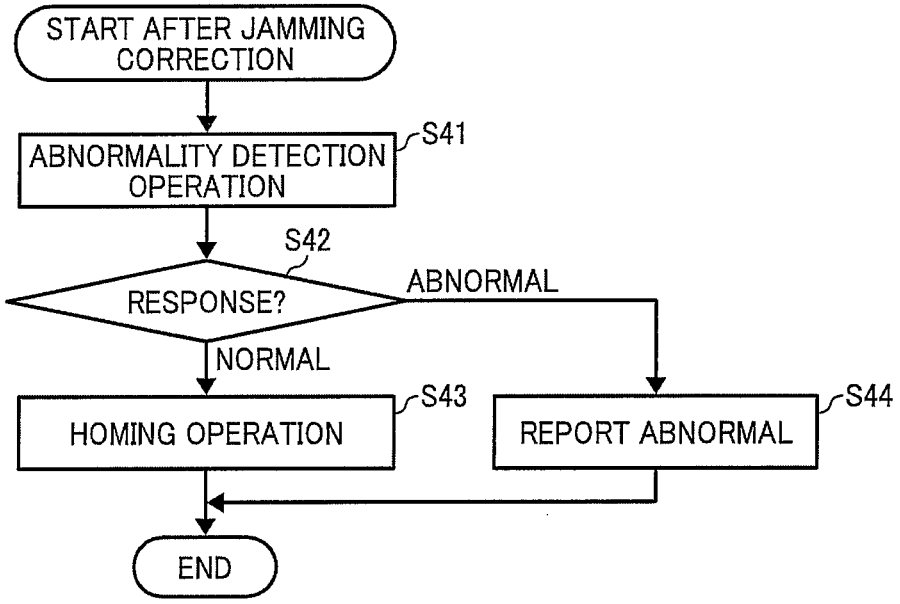
FIG. 14 is a flowchart showing steps of a process of the carriage control by the main controller of FIG. 3 when power is turned ON after returning from a jamming correction process.

A description is given of a process of the carriage 5 when the power is turned ON after returning from the jamming (JAM) correction process. FIG. 14 is a flowchart showing steps of a process of the carriage control when the power is turned ON after returning from the jamming (JAM) correction process. In this case, when the power is turned ON for the image forming apparatus 100 after returning from the jamming correction process, the capping may not be set.

When the power is turned ON after returning from the jamming correction process, the CPU 210 of the main controller 200 starts the process of FIG. 14. The process of FIG. 14 can be started when the power is turned ON while the capping is not set due to other reasons. When the control process of FIG. 14 is started, the CPU 210 of the main controller 200 instructs the FPGA 220 to conduct the abnormality detection operation at step S41.

With this abnormality detection operation, an out-of-control movement of the carriage 5 can be prevented effectively. For example, when the jamming occurs to the apparatus due to the out-of-control movement of the carriage 5, the jamming correction process is conducted and when the apparatus is returned from the jamming correction process by turning the power ON or OFF, the above described abnormality detection operation is conducted, by which the second time out-of-control movement of the carriage 5 can be prevented. Further, even if a drive system of the carriage 5 becomes abnormal due to some malfunction, the abnormal can be detected without the out-of-control movement of the carriage 5 by conducting the above described abnormality detection operation.

Upon completing the abnormality detection operation, the CPU 210 proceeds to steps S42 and subsequent steps. Similar to step S3 to S5 of FIG. 4, at steps S42 to S44, the CPU 210 conducts the homing operation or reports an abnormal response based on the response from the FPGA 220, and ends the process. Further, the homing operation is not required after conducting the abnormality detection operation. However, if the abnormality detection operation is started under a condition that an absolute position of the carriage 5 is not identified, the homing operation is required.

It should be noted that numerous additional modifications and variations are possible in light of the above teachings. It is therefore to be understood that, within the scope of the appended claims, the disclosure of the present invention may be practiced otherwise than as specifically described herein. For example, in the above described example embodiment, a given output to the main scanning motor 8 by the motor controller 225 is the setting voltage, but depending on the type of the main scanning motor 8 that can be conduct current control, the given output to the main scanning motor 8 can be setting current. Further, in the above described example embodiment, the encoder sensor 41 reads the encoder sheet 40, and the encoder sensor 41 outputs the pulse numbers of the encoder signal, and the position of the carriage 5 is detected by counting the pulse numbers, but the position of the carriage 5 can be detected differently.

Further, in the above described example embodiment, the control of the abnormality detection operation shown in FIG. 5, FIG. 9 or FIG. 10 is conducted before conducting the feedback control by the sensor processing unit 224 and the motor controller 225, but the control of the abnormality detection operation can be conducted when starting the feedback control, in which the CPU 210 can add a drive instruction of low speed and short distance of the carriage 5 to the FPGA 220 with a time limit. In this case, the motor controller 225 of the FPGA 220 conducts the abnormality detection operation within the time limit, then stops the carriage 5 compulsory, and then conducts a normal feedback control.

Further, in the above described example embodiment, print data is received from the external apparatus and then the image forming apparatus using the inkjet method (inkjet printer) prints color image, but not limited hereto. The above described example embodiment can be applied to other image forming apparatuses such as digital copiers and digital multi-functional peripherals (MFPs) which may include an image scanning unit such as a scanner to scan color image of documents, and use image data received from the image scanning unit for printing color image.

Further, the above described example embodiment can be applied to monochrome image forming apparatuses, and image forming apparatuses using two or three colors. Further, other than the image forming apparatus using the inkjet method, the above described example embodiment can be applied to image forming apparatuses that form an image on a recording medium using a carriage having a recording head and a scan motor that drives the carriage. For example, the above described example embodiment can be applied to image forming apparatuses using the thermal method, which does not dispense ink droplets. Further, the above described example embodiment can be applied various driver apparatuses including a moveable unit other than the carriage and a drive unit to drive the moveable unit.

Further, the above described example embodiment can be applied to apparatuses other than image forming apparatuses. For example, the above described example embodiment can be applied to a driver apparatus that moves a moveable unit along a given path. Further, the given path is not required to be a straight path, and the path is not required to be defined by physical parts such as a rod.

In the above described driver apparatus according to one embodiment of the present invention, when the moveable unit is driven to move the moveable unit along a given path, abnormal drive of the moveable unit can be determined at a desired timing. With this features, the drive unit such as the main scan motor can be controlled effectively, and undesirable high speed impact of the moveable unit to the wall, which may cause damage to the moveable unit such as the carriage, deformation of apparatus, damage to a belt connection part or the like, can be prevented.

The above described method for controlling the driver apparatus can be implemented using a program of the above described method. Specifically, in case of the process shown in FIG. 5, a non-transitory computer-readable storage medium storing a program that, when executed by a computer, causes the computer to execute a method for controlling the driver apparatus can be devised. The method includes the steps of 1) outputting a given voltage to a drive unit for a given time to move a moveable unit along a given path; 2) determining whether the moveable unit is moved for a given distance or more in a driving direction; 3) determining whether the given time elapses after starting the driving of the moveable unit; 4) returning a normal response when the determining step 2) determines that the moveable unit is moved for the given distance or more in the driving direction; and 5) returning an abnormal response indicating occurrence of abnormality when the determining step 3) determines that the given time elapses after starting the driving of the moveable unit.

Further in case of the process shown in FIG. 10, a non-transitory computer-readable storage medium storing a program that, when executed by a computer, causes the computer to execute a method for controlling the driver apparatus can be devised. The method includes the steps of 1) outputting a given voltage to a drive unit for a given time to move a moveable unit along a given path; 2) determining whether the moveable unit is moved for a given distance or more; 3) determining whether the moving direction is same as a driving direction when the determining step 2) determines that the moveable unit is moved for the given distance or more; 4) determining whether the given time elapses after starting the driving of the moveable unit when the determining step 2) determines that the moveable unit is not moved for the given distance or more; 5) returning a normal response when the determining step 3) determines that the moveable unit is moved in the driving direction; and 6) returning an abnormal response indicating occurrence of abnormality when the determining step 3) determines that the moving direction is not same as the driving direction or when the determining step 4) determines that the given time elapses after starting the driving of the moveable unit.

The program can be distributed by storing the program in a storage medium or carrier medium such as CD-ROM. Further, the program can be distributed by transmitting signals from a given transmission device via a transmission medium such as communication line or network (e.g., public phone line, specific line) and receiving the signals. When transmitting signals, a part of data of the program is transmitted in the transmission medium, which means, entire data of the program is not required to be on in the transmission medium. The signal for transmitting the program is a given carrier wave of data signal including the program. Further, the program can be distributed from a given transmission device by transmitting data of program continually or intermittently.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a Wireless Application Protocol (WAP) or 3G-compliant phone) and so on. Since the present invention can be implemented as software, each and every aspect of the present invention thus encompasses computer software implementable on a programmable device.

The computer software can be provided to the programmable device using any storage medium, carrier medium, carrier means, or digital data carrier for storing processor readable code such as a flexible disk, a compact disk read only memory (CD-ROM), a digital versatile disk read only memory (DVD-ROM), DVD recording only/rewritable (DVD-R/RW), electrically erasable and programmable read only memory (EEPROM), erasable programmable read only memory (EPROM), a memory card or stick such as USB memory, a memory chip, a mini disk (MD), a magneto optical disc (MO), magnetic Tape, a hard disk in a server, a solid state memory device or the like, but not limited these.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

In the above-described example embodiment, a computer can be used with a computer-readable program, described by object-oriented programming languages such as C++, Java (registered trademark), JavaScript (registered trademark), Perl, Ruby, or legacy programming languages such as machine language, assembler language to control functional units used for the apparatus or system. For example, a particular computer (e.g., personal computer, work station) may control an information processing apparatus or an image processing apparatus such as image forming apparatus using a computer-readable program, which can execute the above-described processes or steps. In the above described embodiments, at least one or more of the units of apparatus can be implemented in hardware or as a combination of hardware/software combination. In example embodiment, processing units, computing units, or controllers can be configured with using various types of processors, circuits, or the like such as a programmed processor, a circuit, an application specific integrated circuit (ASIC), used singly or in combination.

Numerous additional modifications and variations are possible in light of the above teachings. It is therefore to be understood that, within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A driver apparatus, comprising:

a motor configured to move a carriage;

a driver configured to:

output a first voltage for a given time to the motor to move the carriage in a first direction, output a second voltage to the motor to move the carriage in a second direction that is an opposite direction to the first direction when the carriage does not move for a given distance after outputting the first voltage for the given time, output a third voltage to the motor that is greater than the first voltage to move the carriage in the first direction when the carriage does not move for the given distance after outputting the second voltage, and output a fourth voltage to the motor that is greater than the second voltages to move the carriage in the second direction when the carriage does not move for the given distance after outputting the third voltage; and a determination unit configured to determine that abnormality occurs when the carriage does not move for the given distance after outputting the fourth voltage to the motor.

2. The driver apparatus of claim 1, wherein:

an absolute value of the first voltage and an absolute value of the second voltage are equal.

3. The driver apparatus of claim 1, wherein:

an absolute value of the third voltage and an absolute value of the fourth voltage are equal.

4. The driver apparatus of claim 1, wherein the driver is configured to direct the motor to stop movement of the carriage when the carriage travels at least the given distance.

5. The driver apparatus of claim 1, wherein the given distance corresponds to a minimum unit of movement detection of a movement detector and a multiplication of the minimum unit.

6. The driver apparatus of claim 1, further comprising a reporting unit, wherein the reporting unit reports the abnormality to a user.

7. A method of controlling a driver apparatus, the method comprising the steps of:

moving a carriage;

outputting a first voltage for a given time to the motor to move the carriage in a first direction;

outputting a second voltage to the motor to move the carriage in a second direction that is an opposite direction to the first direction when the carriage does not move for a given distance after outputting the first voltage for the given time;

outputting a third voltage to the motor that is greater than the first voltage to move the carriage in the first direction when the carriage does not move for the given distance after outputting the second voltage;

outputting a fourth voltage to the motor that is greater than the second voltages to move the carriage in the second direction when the carriage does not move for the given distance after outputting the third voltage; and determining that abnormality occurs when the carriage does not move for the given distance after outputting the fourth voltage to the motor.

* * * * *